US012209752B2

(12) United States Patent
Kim

(10) Patent No.: US 12,209,752 B2
(45) Date of Patent: Jan. 28, 2025

(54) COOKING APPLIANCE

(71) Applicant: LG Electronics Inc., Seoul (KR)

(72) Inventor: Jinhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 466 days.

(21) Appl. No.: 17/579,754

(22) Filed: Jan. 20, 2022

(65) Prior Publication Data

US 2022/0228754 A1 Jul. 21, 2022

(30) Foreign Application Priority Data

Jan. 20, 2021 (KR) ..... 10-2021-0008191

(51) Int. Cl.
*F24C 15/02* (2006.01)

(52) U.S. Cl.
CPC ..... *F24C 15/021* (2013.01); *F24C 15/023* (2013.01)

(58) Field of Classification Search
CPC ..... F24C 15/021; F24C 15/023; F24C 15/02; F24C 15/028
USPC ..... 126/190
See application file for complete search history.

(56) References Cited

U.S. PATENT DOCUMENTS 5,709,390 A * 1/1998 Faccoli ..... F24C 15/021 277/921

FOREIGN PATENT DOCUMENTS

| | | |
|---|---|---|
| DE | 8411266 | 12/1986 |
| DE | 10119789 | 10/2002 |
| DE | 102006002918 | 7/2007 |
| EP | 0992740 | 4/2000 |
| EP | 1257771 | 11/2002 |
| EP | 1340021 | 4/2006 |
| KR | 19990031387 | 5/1999 |
| KR | 20100112339 | 10/2010 |

OTHER PUBLICATIONS

Extended European Search Report in European Appln. No. 22152323.6, dated Jun. 13, 2022, 10 pages.

* cited by examiner

*Primary Examiner* — Vivek K Shirsat
(74) *Attorney, Agent, or Firm* — Fish & Richardson P.C.

(57) ABSTRACT

A cooking appliance includes a packing member disposed between a case and a door and a fixing member which fixes the packing member to any one of the case and the door. The packing member and the fixing member are coupled in the form in which both sides in a front-rear direction of the fixing member inserted into the packing member are surrounded by the packing member.

19 Claims, 9 Drawing Sheets

COOKING APPLIANCE

CROSS-REFERENCE TO RELATED APPLICATION

This application claims priority to and the benefit of Korean Patent Application No. 10-2021-0008191, filed on Jan. 20, 2021, the disclosure of which is incorporated herein by reference in its entirety.

TECHNICAL FIELD

The present invention relates to a cooking appliance, and more specifically, to a cooking appliance provided to open or close a cooking chamber of an oven or the like.

BACKGROUND

A cooking appliance is one of electrical home appliances for cooking food and is installed in a kitchen space to cook food according to user intent. Such cooking appliances may be variously classified according to a heat source or type and a type of fuel.

When the cooking appliances are classified according to the type of cooking food, the cooking appliances are classified into open-type cooking appliances and closed-type cooking appliances according to the form of a space in which food is placed. The closed-type cooking appliances may include an oven, a microwave, and the like, and the open-type cooking appliances may include a cooktop, a hob, a griddle, and the like.

The closed-type cooking appliance is a cooking appliance in which a space, in which food is positioned, is blocked and the blocked space is heated to cook food. A cooking chamber, which has a space in which the food is placed and is blocked when food is cooked, is provided in the closed-type cooking appliance. The cooking chamber has a space in which the food is actually cooked.

The closed-type cooking appliances are mainly classified into a gas oven and an electric oven according to a type of heat source. The gas oven uses gas as fuel and cooks food in a manner of using flame generated when the gas is supplied to a plurality of burners, ignited, and burned. Unlike the gas oven, the electronic oven uses electricity as a heat source and cooks food in a manner of using heat generated by a plurality of heaters when the heaters operate.

In the closed-type cooking appliance, a door which selectively opens or closes the cooking chamber may be rotatably provided. The door may be installed on a main body, in which the cooking chamber is formed, to be rotatable by a door hinge provided between the main body and the door and may rotate about a portion coupled to the main body by the door hinge to selectively open or close the cooking chamber.

The door is disposed at the open front of the cooking chamber to open or close the cooking chamber, and a gasket may be provided between a front surface of a cavity constituting the cooking chamber and the door. The gasket serves to prevent heat in the cooking chamber from leaking to the outside of the cooking chamber when the cooking chamber is closed.

Conventionally, the gasket may be manufactured of a rubber-based material having an elastic restoring force and installed on the front surface of the cavity or the door. The gasket may maintain a sealed state of the cooking chamber using the elastic restoring force when the cooking chamber is closed.

In the related art, an oven door packing fixing structure of a gas oven range is disclosed. In the related art, brackets formed of the same material as a packing body are integrally formed to protrude from a plurality of portions at a lower surface of a packing to fix the packing formed of a rubber material to an inner surface of the oven door.

In addition, in a packing coupling portion of the oven door, bracket fixing holes having the same shape as the bracket are formed. As the brackets are fixedly inserted into the bracket fixing holes, the packing is fixed.

In the related art, the packing body and the bracket are formed of the same material. In this case, the packing body and the bracket should be formed of the same rubber material having an elastic restoring force or the same material having a high hardness.

However, when the bracket is formed of the rubber-based material, there is a problem in that the packing is not properly fixed, and when the packing body is formed of a high hardness material, there is a problem in that the cooking chamber is not sealed properly.

When considering the above-described content, the packing body, that is, a gasket body, may be formed of the rubber-based material, and the bracket may be separately formed of a material having a high hardness.

Generally, the gasket may be molded using a thermoplastic resin in an injection manner. In the gasket, a bracket formed of a metal material for fixing the gasket to the front surface of the cavity or the door may be installed.

Conventionally, a gasket and a bracket are molded separately, and the bracket is installed on the gasket in a manner in which the bracket is bonded to the gasket. However, according to such a bracket installation manner, not only a separate process of bonding the bracket to the gasket is added, but also there is a disadvantage of a risk in which the bracket is separated from the gasket due to deformation of a bonded portion when exposed to high temperatures.

In order to solve the problems, a process of molding a gasket and a process of installing a bracket may be performed at the same time in an insert-injection manner. For example, a gasket may be molded in an insert-injection manner in which a pre-manufactured bracket is inserted into a thermoplastic resin for molding the gasket, and the gasket and a bracket may be integrally molded through the insert-injection molding manner.

As a material of the gasket, a silicone rubber, which has elasticity and high moldability, has been used. However, the gasket formed of a silicone rubber material has a disadvantage in that the gasket is thermally cured and crumbles when exposed to high temperatures.

In order to solve the problem of the gasket formed of the silicone rubber, a fluorine rubber material may be applied as a material of the gasket. Since fluorine rubber has higher heat resistance than silicone material, there is a low possibility of the fluorine rubber being cured and crumbling when exposed to high temperatures.

However, since the fluorine rubber material has a lower hardness than the silicone rubber material, the fluorine rubber material has a property of being easily torn when compared to the silicone rubber material. In addition, when it is assumed that an overall thickness of the gasket is constant, the thickness of the gasket surrounding the bracket is very small when compared to other portions, and thus there is a high possibility in which the gasket is torn at a peripheral portion of the gasket.

That is, when the gasket is molded using the fluorine rubber material, there may be a problem in that a risk of the gasket being torn and the bracket being separated therefrom becomes higher than that of a gasket formed of the silicone rubber material.

In addition, the moldability of the fluorine rubber material is not good when compared to the silicone rubber material. That is, when the gasket is molded using the fluorine rubber material, there is a high possibility of the gasket being molded in a state in which the gasket does not properly surround a periphery of the gasket. When the gasket is molded in the state in which the gasket does not properly surround the periphery of the bracket, a possibility of the gasket being torn at a peripheral portion of the bracket is raised, and thus a possibility of the gasket being separated therefrom is raised.

RELATED ART

Patent Document

Korean Patent Publication No. 10-1999-0031387 (Tile of Invention: DOOR PACKING FOR GAS OVEN RANGE)

SUMMARY

Technical Problems

The present invention is directed to providing a cooking appliance including a packing member with an improved structure in which a heat resistance is high and a risk of tearing and separation of a bracket is decreased.

Technical Solutions

To achieve the objectives, a cooking appliance according to one embodiment of the present invention includes a packing member disposed between a cavity and a door and a fixing member which fixes the packing member to any one of the cavity and the door, wherein the packing member and the fixing member are coupled in the form in which both sides in a front-rear direction of the fixing member inserted into the packing member are surrounded by the packing member.

According to one aspect of the present invention, there is provided a cavity in which a cooking chamber is formed, wherein an opening is formed in the front of the cooking chamber, a door disposed on the front of the cavity to open or close the cooking chamber, a packing member disposed between the cavity and the door, and a fixing member which couples the packing member to any one of the cavity and the door, wherein the packing member includes a first packing part formed in a shape surrounding the opening in front of the cavity and a second packing part formed to protrude from the first packing part in a direction toward the door or the cavity, the fixing member includes a first fixing part inserted into the first packing part and a second fixing part connected to the first fixing part to be coupled to any one of the cavity and the door, an insertion portion, into which at least a part of the first fixing part is inserted, is provided in the first packing part, and the insertion portion is formed to be recessed into the first packing part at a position at which both sides in a front-rear direction of the first fixing part inserted into the insertion portion are surrounded by the first packing part.

The insertion portion may include a first insertion portion formed to be recessed from one side surface of the first packing part facing the second fixing part in a direction toward an inner portion of the first packing part and a second insertion portion formed to be recessed into the first packing part in a direction different from the direction of the first insertion portion, connected to the first insertion portion, and spaced apart from the one side surface of the first packing part by a predetermined distance.

The first insertion portion may be formed to be recessed from a rear surface of the first packing part in the forward direction, and the second insertion portion may be formed to be recessed from a front end portion of the first insertion portion in a direction parallel to the rear surface of the first packing part.

The insertion portion may be formed in a shape in which the first insertion portion and the second insertion portion are connected in an "L" shape.

The second insertion portion may be disposed in the first packing part to be spaced apart from the one side surface of the first packing part by 0.5 mm or more.

At least a part of the second fixing part may be formed in a shape corresponding to a shape of the first insertion portion and connected to the first fixing part in the insertion portion.

The first fixing part may be formed to extend from the second fixing part inserted into the first insertion portion in a direction parallel to a direction in which the second insertion portion is recessed.

A front surface and a rear surface of the first fixing part inserted into the second insertion portion may be pressed against an inner surface of the first packing part in the first packing part, and the first fixing part may be fixed to the inner portion of the first packing part.

In a state in which the first fixing part is inserted into the first packing part, the packing member and the fixing member may be insert-injected so that the packing member and the fixing member are integrally molded.

The packing member may be formed of a material having higher heat resistance than silicone rubber.

The packing member may be formed of a fluorine rubber material.

Advantageous Effects

According to a cooking appliance of the present invention, since a packing member is molded using a fluorine rubber resin having a high heat resistance, the packing member, which does not crumble and effectively allows a cooking chamber to maintain a sealed state even when exposed to high temperatures while cooking, can be provided.

In addition, since the packing member can be insert-injection molded with a fixing member while surrounding the fixing member with a sufficient thickness, even in a high temperatures state, the sealed state of the cooking chamber can be effectively maintained, and a risk of the packing member being torn and a bracket being consequently separated therefrom can be reduced significantly.

BRIEF DESCRIPTION OF DRAWINGS

The above and other objects, features, and advantages of the present invention will become more apparent to those of ordinary skill in the art by describing exemplary embodiments thereof in detail with reference to the accompanying drawings.

DETAILED DESCRIPTION

Figure 1:
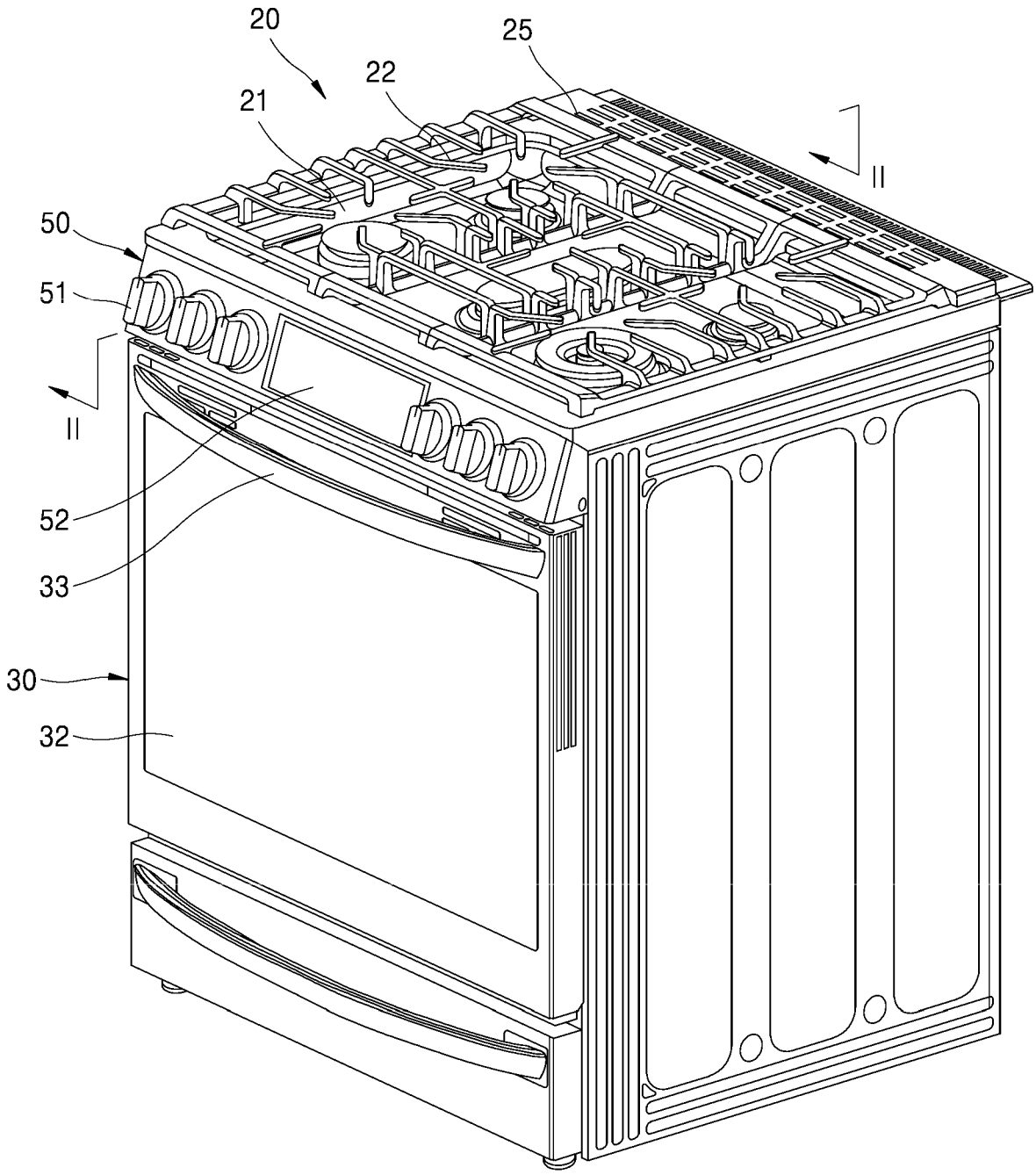
FIG. 1 is a front perspective view illustrating a cooking appliance according to one embodiment of the present invention.

The above-described purposes, features, and advantages will be described in detail with reference to the accompanying drawings, and thus the technical spirit of the present invention may be easily executed by those skilled in the art. When it is determined that the detailed descriptions of related well-known technologies unnecessarily obscure the gist of the invention, the detailed descriptions will be omitted. Hereinafter, exemplary embodiments of the present invention will be described in detail with reference to the accompanying drawings. The same or similar elements are denoted by the same reference numerals in the drawings throughout this specification.

Although terms such as first, second, or the like may be used for describing various elements, the elements are not limited to the terms. The terms are only used to distinguish one element from another element, and unless otherwise specifically described, a first element may also be a second element.

The present invention is not limited to the embodiments to be disclosed below and may be variously changed and implemented in various different forms. The embodiments are only provided in order to fully explain the present disclosure and fully explain the scope of the present invention to those skilled in the art. Accordingly, the present invention is not limited to the embodiments disclosed below and should be understood to not only replace a component of any one embodiment with the component of another embodiment but also include modifications, equivalents, and alternatives that fall within the technical spirit and scope of the present invention.

The accompanying drawings are only provided so that the embodiments disclosed in the specification are easily understood, and a technical concept of the present invention is not limited thereto, but it will be understood that the invention is to cover all modifications, equivalents, and alternatives falling within the spirit and scope of the invention. Components in the drawings may be illustrated in such a way that sizes and thicknesses are exaggerated to be great or small in consideration of convenience of understanding or the like, but the scope of the present invention is not limited thereto The terminologies used in the present specification are for the purpose of describing particular embodiments only and are not intended to be limited to the invention. In addition, the singular forms "a" and "an" include the plural forms as well, unless the context clearly indicates otherwise. It should be understood that the terms "comprises," "comprising," "includes," and/or "including" used in the specification specify the presence of stated features, integers, steps, operations, elements, components, and/or groups thereof. That is, it should be understood that the terms "comprises," "comprising," "includes," and/or "including" used in the specification do not preclude the presence or addition of one or more other features, integers, steps, operations, elements, components, and/or groups thereof.

Although the terms "first," "second," and the like may be used herein to describe various elements, these elements should not be limited by these terms. These terms are only used for distinguishing one element from another.

When an element is referred to as being "connected" or "coupled" to another element, it will be understood that the element can be directly connected or coupled to another element, or other elements may be present therebetween. In contrast, when an element is referred to as being "directly connected" or "directly coupled" to another element, it will be understood that there are no intervening elements.

When a certain component is described as being present on or under another component, it will be understood that the element may be directly disposed on or under another element, or other elements may be present therebetween.

Unless otherwise defined, all terms including technical and scientific terms used herein have meanings which are the same as meanings generally understood by those skilled in the art. Terms, such as those defined in commonly used dictionaries, should be interpreted as having meanings that are consistent with their meanings in the contexts of the relevant art and will not be interpreted in an idealized or overly formal sense unless expressly so defined here.

In a state in which a cooking appliance is placed on a floor, a direction in which a door is installed with respect to a center of the cooking appliance is defined as a forward direction. Accordingly, a direction in which food enters an inner portion of the cooking appliance after the door is opened is a rearward direction. For the sake of convenience, a direction toward the forward direction or the rearward direction may be referred to as a first direction. Then, the forward direction may be referred to as one direction of the first direction, and the rearward direction may be referred to as the other direction of the first direction.

In addition, a gravity direction may be defined as a downward direction, and a direction opposite to the gravity direction may be defined as an upward direction.

In addition, a transverse direction perpendicular to the front-rear direction of the cooking appliance, that is, a width direction of the cooking appliance when the cooking appliance is viewed in front of the door, may be referred to as a left-right direction. For the sake of convenience, the left-right direction may be referred to as a second direction. Then, the rightward direction may be referred to as one direction of the second direction, and the leftward direction may be referred to as the other direction of the second direction.

In addition, the width direction of the cooking appliance may be referred to as a lateral direction. Then, the rightward direction may be referred to as one direction of the lateral direction, and the leftward direction may be referred to as the other direction of the lateral direction.

In addition, the above-described upward and downward directions may be referred to as a third direction. Then the upward direction may be referred to as one direction of the third direction, and the downward direction may be referred to as the other direction of the third direction.

In addition, the above-described upward and downward directions may be referred to as a vertical direction. Then, a front-rear direction and a left-right direction, that is, the first direction and the second direction, may be referred to as a horizontal direction.

Throughout the specification, unless otherwise specifically described, "A and/or B" refers to "A, B, or A and B," and "C to D" refers to "more than or equal to C and less than or equal to D."

[Overall Structure of Cooking Appliance]

FIG. 1 is a front perspective view illustrating a cooking appliance according to one embodiment of the present invention.

Figure 2:
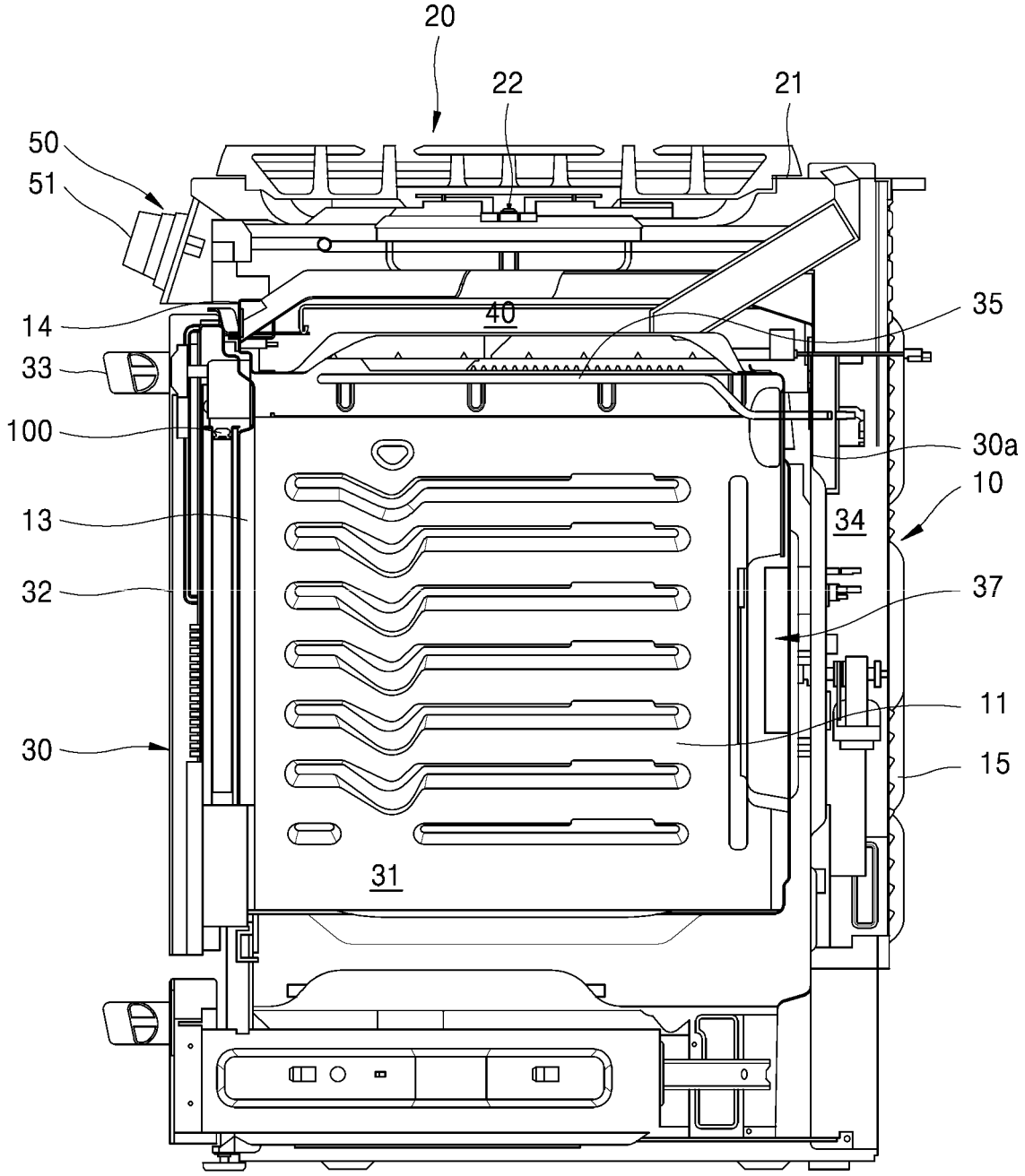
FIG. 2 is a side cross-sectional view illustrating an inner structure of the cooking appliance illustrated in FIG. 1.

FIG. 2 is a side cross-sectional view illustrating an inner structure of the cooking appliance illustrated in FIG. 1.

Referring to FIGS. 1 and 2, the cooking appliance according to one embodiment of the present invention may include a cook top part 20 and an oven part 30.

An exterior of the cooking appliance 1 may be formed by a main body 10. The main body 10 may be formed in a form including a substantially rectangular hexahedron shape and formed of a material having a predetermined strength in order to protect a plurality of components installed in an inner space thereof.

The main body 10 may include a case 11 constituting a frame of the main body 10 and defining a cavity and a front panel 13 which is disposed on the front of the case 11 and constitutes a front surface of the main body 10. A cooking chamber 31 may be formed in the case 11, and an opening, which opens the cooking chamber 31 in the forward direction, may be formed in the front panel 13.

The cook top part 20 may be disposed on the main body 10. The cook top part 20 may be provided to heat food or heat a container containing food placed in an open space, that is, on an upper side thereof, so as to cook food. A top plate 21, which constitutes an exterior of an upper surface of the cook top part 20 and closes an upper end of the main body 10, may be provided on the cook top part 20.

One or more cooktop heating parts 22 for heating food contained in containers may be disposed on the cook top part 20.

As an example, the cooktop heating part 22 may be provided as a heating apparatus using gas fuel. As another example, the cooktop heating part may be provided as a heater or induction heating part using electricity. As described above, a structure of the cooktop heating part 22 may be changed according to a type of heat source.

In addition, the oven part 30 may be disposed under the cook top part 20. The cooking chamber 31, which provides a space in which food is cooked, may be provided in an inner space of the oven part 30.

The case 11 may be formed in a hexahedron shape having an open front surface, and the cooking chamber 31 may be formed in the case 11. That is, the cooking chamber 31 may be formed in a substantially hexahedron shape disposed in the case 11 and may be formed to have a space that is open forward.

In a state in which the cooking chamber 31 is sealed, while an inner portion of the cooking chamber 31 is heated, food may be cooked. That is, in the oven part 30, the cooking chamber 31 has a space in which the food is actually cooked.

A heating part, which heats the cooking chamber 31, may be provided in the cooking appliance. The heating part may be provided as a heating apparatus using gas fuel. As another example, the cooktop heating part may be provided as a heater using electricity. As described above, a structure of the heating part may be changed according to a type of used heat source.

In the present embodiment, the heating part is illustrated as being provided as the heating apparatus using the gas fuel. Then, a broil burner 35, which heats the inner space of the cooking chamber 31 from above, may be provided at an upper side of the cooking chamber 31, and a baker burner type burner, which heats the inner space of the cooking chamber 31 from below, may be further provided at a lower side of the cooking chamber 31.

In addition, a convection part 37, which moves hot air by convection to heat the inner space of the cooking chamber 31, may be further provided at a rear side of the cooking chamber 31.

The convection part 37 forcibly moves the air in the inner space of the cooking chamber 31. That is, the convection part 37 moves the air by suctioning and heating the air in the inner space of the cooking chamber 31 and discharging the heated air to the inner space of the cooking chamber 31 so that the inner space of the cooking chamber 31 is heated, and thus, food positioned in the inner space of the cooking chamber 31 is uniformly heated.

A door 32, which selectively opens or closes the cooking chamber 31, may be rotatably provided on the oven part 30. As an example, the door 32 may be provided to open or close the cooking chamber 31 in a pull-down manner in which an upper end of the door 32 is vertically rotated about a lower end thereof.

As a whole, the door 32 may be formed in a hexahedron shape having a predetermined thickness. A handle 33 may be disposed on the front of the door 32. The handle 33 is provided to be gripped when a user wants to rotate the door 32. The user may easily rotate the door 32 using the handle 33.

A control panel 50 may be provided on a front surface of the cooking appliance, that is, provided in front of an upper portion of the case 11. The control panel 50 may constitute a part of a front exterior of the cooking appliance. Knobs 51 for adjusting an operation of the cooking appliance, a display 52, which displays an operation state of the cooking appliance, and the like may be provided on the control panel 50.

For example, the control panel 50 may be formed in a form in which an input part 51 and the display 52 are installed on a control panel cover 50*a* disposed above the door 32 and disposed in front of the cook top part 20.

A plurality of operation switches are provided on the input part 51, and the user may directly input an operation signal through the operation switch. In this case, the operation switch may also be provided as a knob type which allows a rotating operation or provided as a button or panel type which allows a pressing operation or touch operation.

In addition, the display 52, which provides operation information of the cooking appliance, food cooking information, and the like, may be further provided on the control panel 50. The user may check various information related to the cooking appliance through the display 52.

As another example, the display 52 may be provided as a touch panel type which allows a touch operation, and thus, the input part 51 and the display 52 may be formed together on one touch panel.

Meanwhile, a rear space 34 may be provided behind the cooking chamber 31. The rear space 34 is disposed behind the case 11 and is a space separated from the cooking chamber 31 by a division surface 30*a* which divides the cooking chamber 31 and the rear space 34 in the front-rear direction. A front boundary surface of the rear space 34 may be defined by the division surface 30*a*, and a rear boundary of the rear space 34 may be defined by a rear cover 15 disposed behind the case 11.

An upper space 40 may be provided outside the case 11. The upper space 40 may be disposed above the case 11 and behind the control panel 50. A space in which components or electric parts constituting the cooktop heating part 22 are installed may be formed in the upper space 40.

For example, when the cooktop heating part 22 is provided as the heating apparatus using the gas fuel, a burner, which burns gas, a supply pipe for supplying the gas to the burner, a valve for adjusting gas supply to the burner, and the like may be disposed in the upper space 40.

As another example, when the cooktop heating part 22 is provided as the heating apparatus using the electricity, the heater or the induction heating part and various electric parts for driving the heater or the induction heating part may be disposed in the upper space 40.

A front surface of the upper space 40 may be blocked by the front panel 13. The front panel 13 may be disposed between the case 11 and the door 32. At least a part of the front panel 13 may be disposed to block the front of the upper space 40. For example, an upper portion of the front panel 13 disposed on the cooking chamber 31 may block the front surface of the upper space 40.

An air suction port 14 may be provided in the front panel 13. The air suction port 14 may be formed to pass through the front panel 13 in the front-rear direction. The air suction port 14 may form a path, through which air outside the upper space 40 is introduced into the upper space 40, in the front panel 13.

[Structure of Packing Member]

Figure 3:
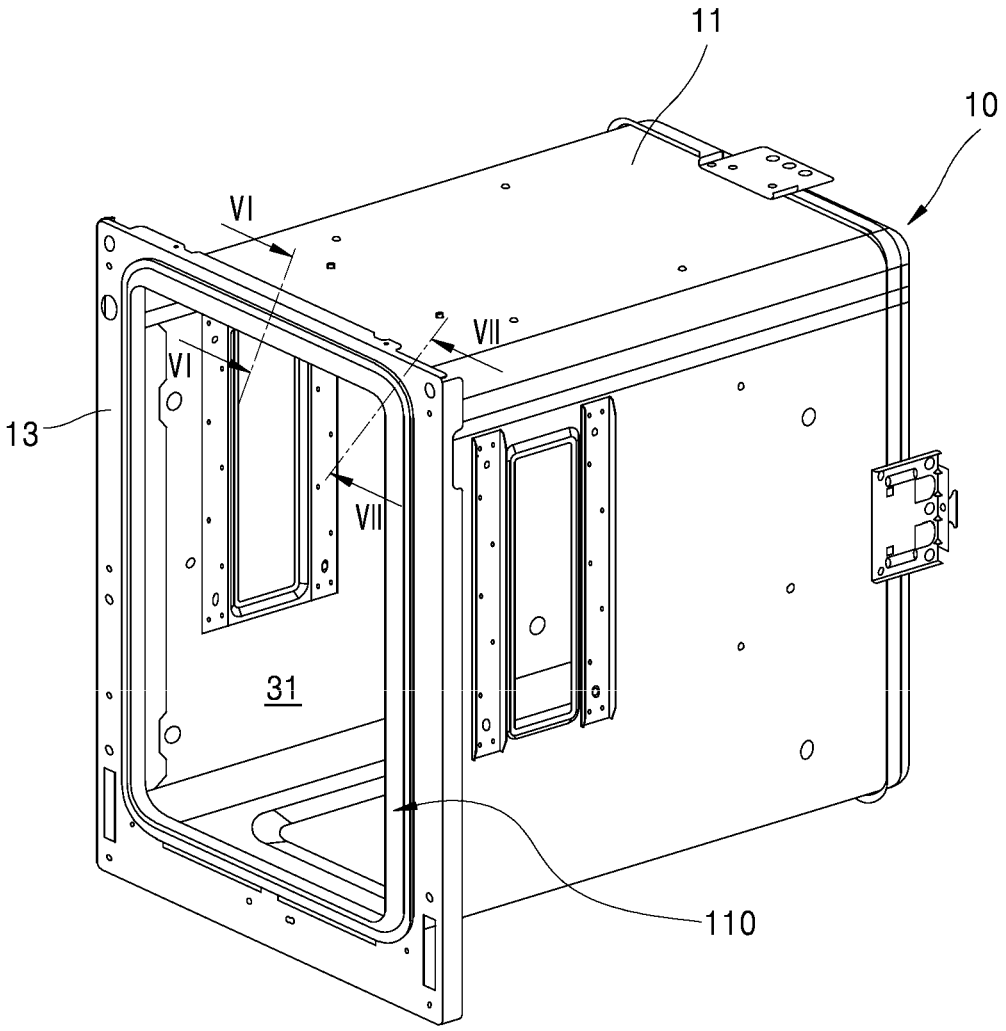
FIG. 3 is a perspective view illustrating a cavity and a packing member, which are separated, illustrated in FIG. 1.
Figure 4:
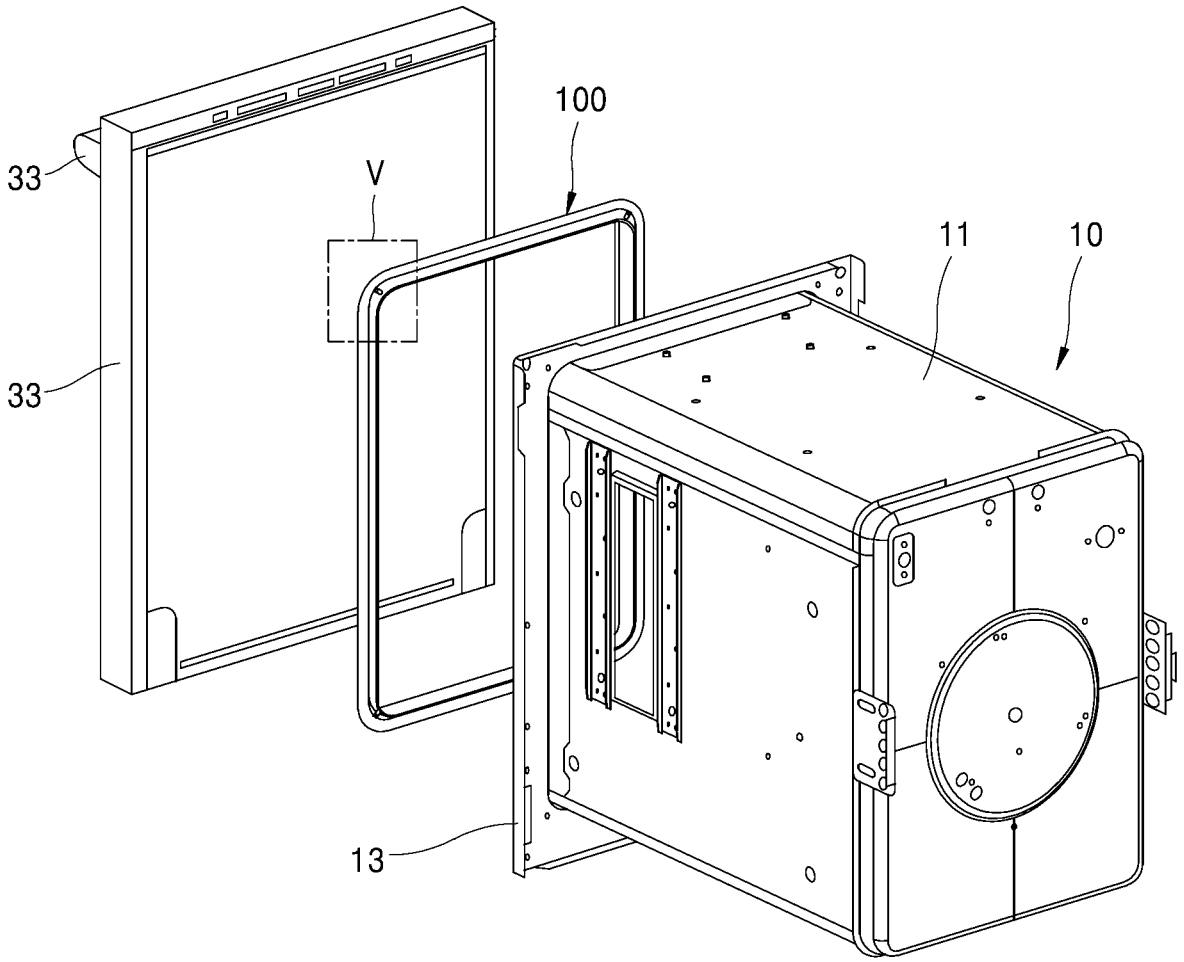
FIG. 4 is a rear perspective view illustrating a disassembled state of the cavity and the packing member illustrated in FIG. 3.
Figure 5:
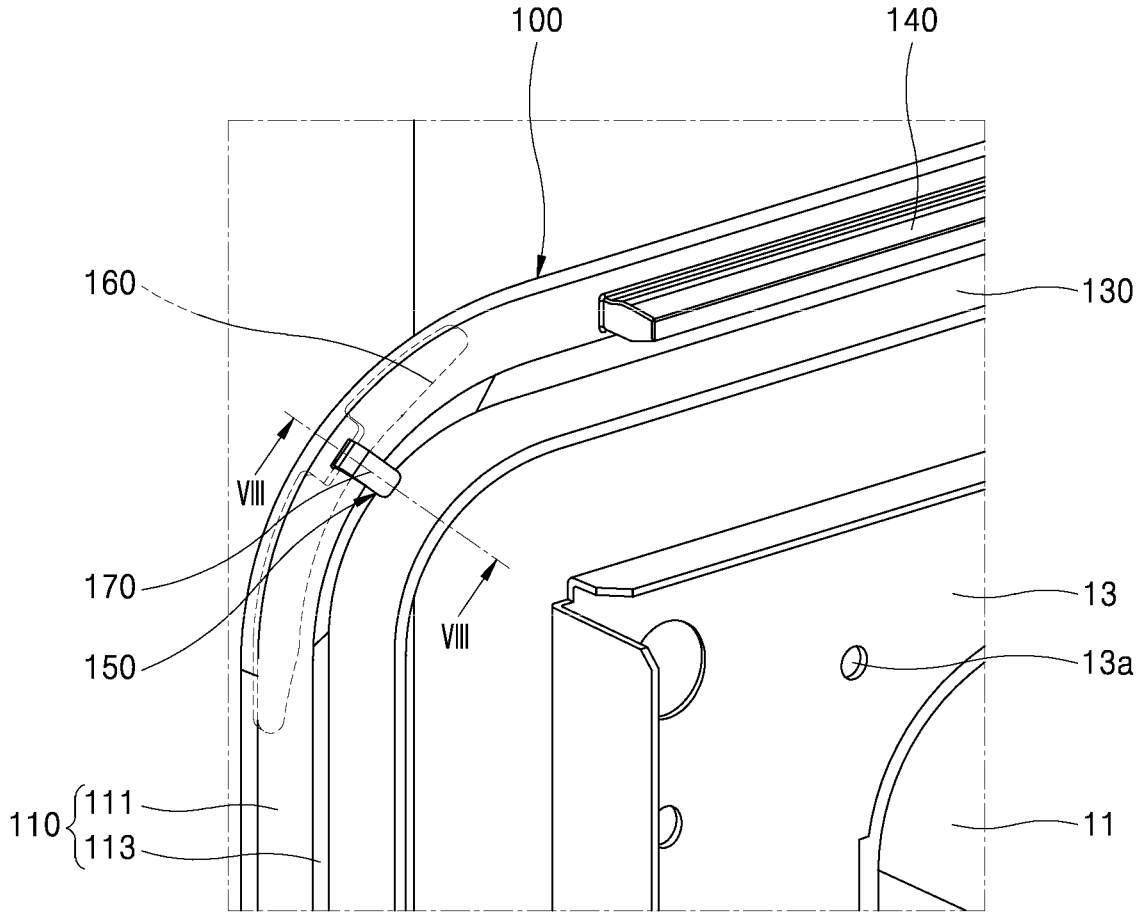
FIG. 5 is an enlarged view illustrating portion V of FIG. 4.
Figure 6:
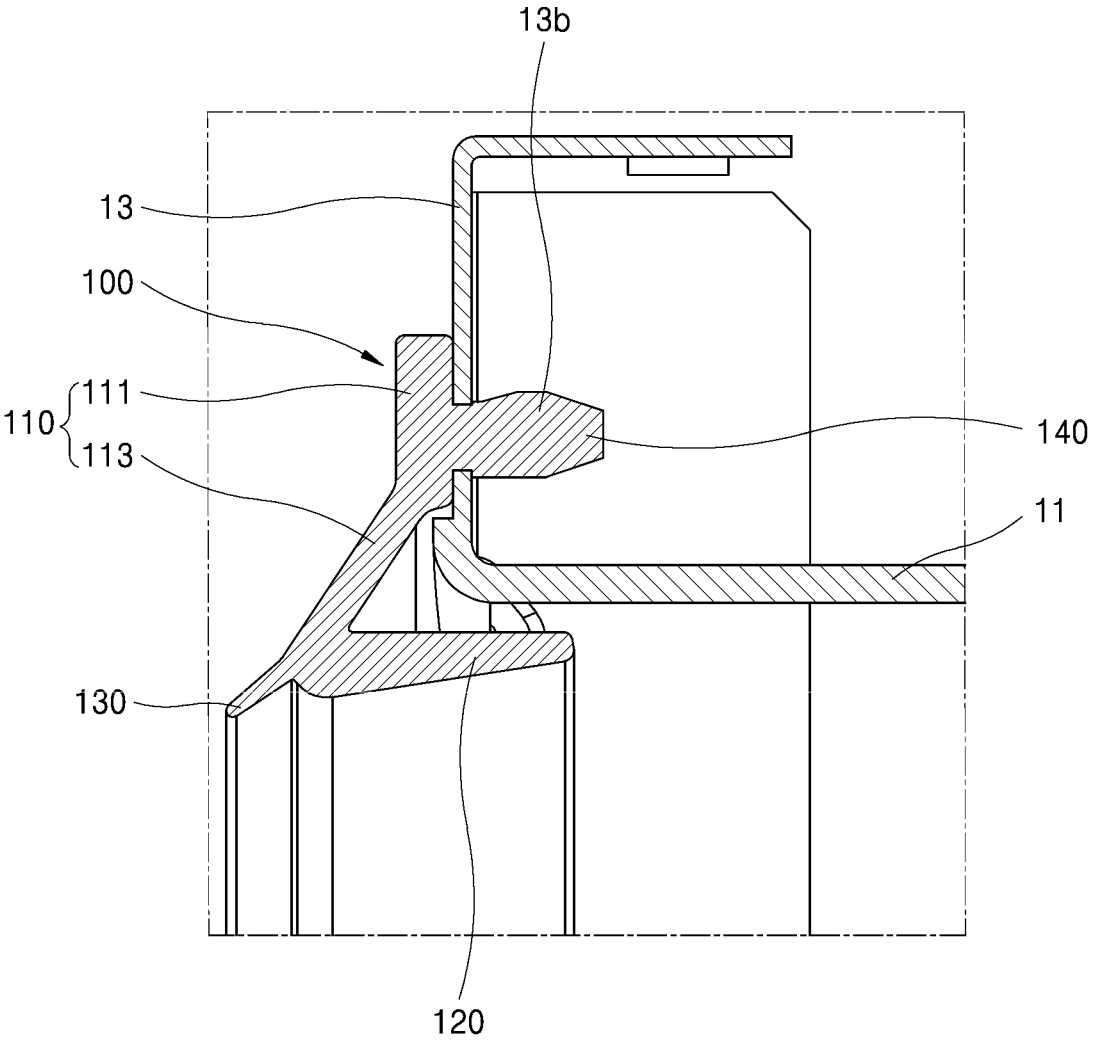
FIG. 6 is a cross-sectional view taken along line VI-VI of FIG. 3.

FIG. 3 is a perspective view illustrating the cavity and a packing member, which are separated, illustrated in FIG. 1, FIG. 4 is a rear perspective view illustrating a disassembled state of the cavity and the packing member illustrated in FIG. 3, FIG. 5 is an enlarged view illustrating portion V of FIG. 4, and FIG. 6 is a cross-sectional view taken along line VI-VI of FIG. 3;

Referring to FIGS. 3 to 5, a packing member 100 may be formed between the case 11 and the door 32. The case 11 can define a cavity that can include a cooking chamber. The packing member 100 may serve to prevent heat in the cooking chamber from leaking to the outside of the cooking chamber when the door 32 closes the cooking chamber 31.

Specifically, the packing member 100 may be disposed between the front panel 13 and the door 32. The packing member 100 may be formed in a shape similar to a shape of an edge of the front panel 13 or an edge of the door 32 and may include a first packing part 110 and a second packing part 120.

The packing member 100 may be coupled to the front panel 13 or the door 32. In the present embodiment, the packing member 100 is illustrated as being coupled to the front panel 13. Hereinafter, an example case in which the packing member 100 is coupled to the front panel 13 will be described for a structure of the packing member 100.

The first packing part 110 may be provided in a form constituting a frame of the packing member 100. The first packing part 110 may be formed in a shape surrounding an opening in the front of the case 11, more specifically, in front of the front panel 13.

The first packing part 110 may be provided in a form including a first packing body part 111 and a first packing connection part 113. The first packing body part 111 of the first packing part 110 may provide a surface coupled to the front panel 13. As an example, the first packing body part 111 may be formed in a shape corresponding to a shape of the front panel 13, for example a "□" shape.

The first packing body part 111 may be coupled to be in surface contact with the front panel 13. Fixing members 150 may be coupled to the first packing body part 111.

The first packing connection part 113 may be formed to protrude from an inner circumferential surface of the first packing body part 111 to be disposed between and connected to the first packing body part 111 and the second packing part 120. The first packing connection part 113 may obliquely protrude from the inner circumferential surface of the first packing body part 111.

For example, the first packing connection part 113 may be disposed from the inner circumferential surface of the first packing body part 111 in a direction between a centripetal direction and a direction toward the door 32 or between the centripetal direction and a direction toward the case 11.

As an example, the first packing connection part 113 may be formed to protrude from the inner circumferential surface of the first packing body part 111 in the direction between the centripetal direction and the direction toward the case 11, that is, to protrude in a direction inclined rearward. As another example, the first packing connection part 113 may be formed to protrude from the inner circumferential surface of the first packing body part 111 in the direction between the centripetal direction and the direction toward the door 32, that is, to protrude in a direction inclined forward.

The second packing part 120 may be formed to protrude from the first packing part 110. The second packing part 120 may be formed to protrude from the first packing part 110, more specifically, from the first packing connection part 113 in a direction toward the door 32 or the case 11.

For example, the second packing part 120 may be formed to protrude from the first packing part 110 in the direction toward the door 32, that is, in the forward direction or from the first packing part 110 in the direction toward the case 11, that is, in the rearward direction. As another example, the second packing part 120 may be formed to protrude from the first packing part 110 in the front-rear direction.

In the present embodiment, the second packing part 120 is illustrated as being formed to protrude from the first packing part 110 in the direction toward the case 11, that is, in the rearward direction. Accordingly, the second packing part 120 may be inserted into the cooking chamber 31 through the opening of the front panel 13. The second packing part 120 may extend in a direction parallel to an inner wall of the case 11 and may be insertion-coupled to the case 11.

In addition, the packing member 100 may further include a third packing part 130. The third packing part 130 may be formed to protrude in a direction which is different from the direction in which the second packing part 120 protrudes. For example, when the second packing part 120 protrudes from the first packing part 110 in the direction toward the cavity in the case 11, the third packing part 130 may be formed to protrude from the first packing part 110 in a direction toward the door 32, that is, in the forward direction.

The packing member 100 may be formed of a rubber-based material having an elastic restoring force. The packing member 100 may be formed of a material having higher heat resistance than silicone rubber. In the present embodiment, the packing member 100 is illustrated as being formed of a fluorine rubber material having higher heat resistance than the silicone rubber.

As described above, since the packing member 100 formed of the fluorine rubber material has higher heat resistance than the silicone robber, there is a low risk of the packing member 100 being thermally cured and crumbling when exposed to high temperatures.

[Structure of Fixing Member]

Figure 7:
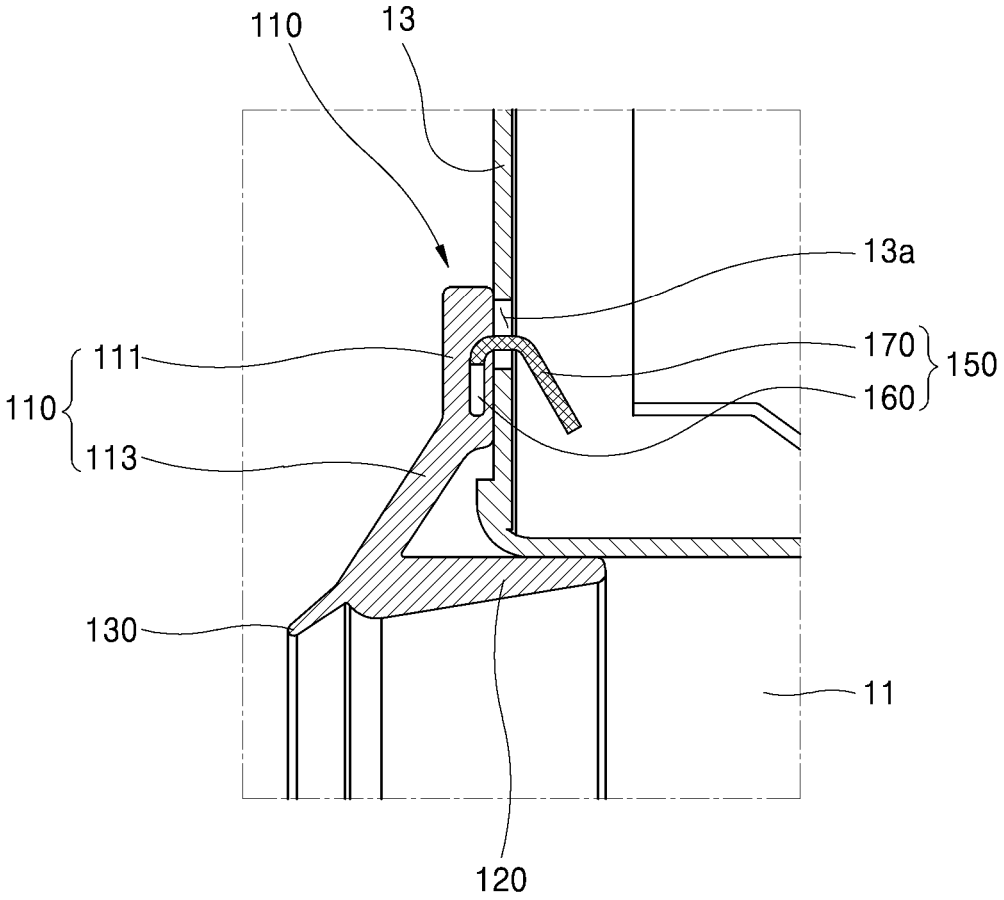
FIG. 7 is a cross-sectional view taken along line VII-VII of FIG. 3.
Figure 8:
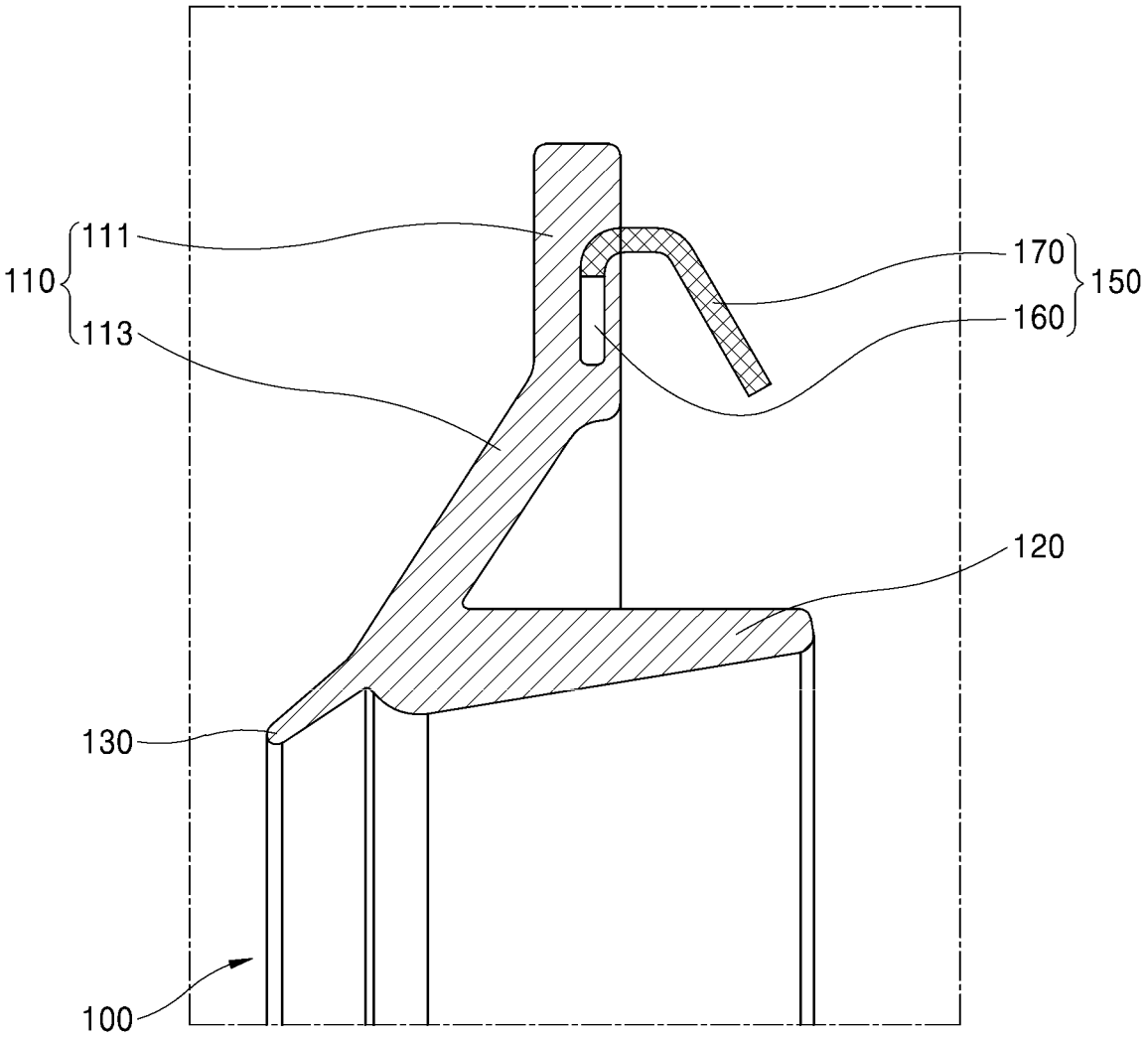
FIG. 8 is an enlarged view illustrating portion VIII of FIG. 7.

FIG. 7 is a cross-sectional view taken along line VII-VII of FIG. 3, and FIG. 8 is an enlarged view illustrating portion VIII of FIG. 7.

As illustrated in FIGS. 5, 7, and 8, fixing members 150 may be provided to couple the packing member 100 to any one of the case 11 and the door 32. In the present embodiment, the fixing member 150 is illustrated as being provided to couple the packing member 100 to the case 11, more specifically, to the front panel 13.

The plurality of fixing members 150 may be disposed between the packing member 100 and the front panel 13 to guide coupling between the packing member 100 and the front panel 13 at a plurality of positions. In the present embodiment, the fixing members 150 are illustrated as being disposed at corners of the packing member 100. However, the present invention is not limited thereto, and the number of the packing members 100 and positions thereof may be determined to be different as necessary.

Each of the fixing members 150 may be formed of a metal material and may include a first fixing part 160 and a second fixing part 170.

The first fixing part 160 may be inserted into the first packing part 110 to be coupled to the packing member 100. Specifically, the first fixing part 160 may be inserted into and coupled to the first packing body part 111.

In the present embodiment, each of the corners of the packing member 100 is illustrated as being formed in a round shape. The first fixing part 160 of the fixing member 150 disposed at the corner of the packing member 100 formed in the round shape as described above may be formed in a round shape corresponding to the shape of the corner of the packing member 100.

For example, the first fixing part 160 may be formed in a metal plate shape similar to an eyebrow shape. More specifically, the first fixing part 160 may be provided in the form of a flat surface parallel to a rear surface of the first packing part 110 facing the front panel 13.

The second fixing part 170 may be connected to the first fixing part 160 to be coupled to any one of the case 11 and the door 32. In the present embodiment, the second fixing part is illustrated as being coupled to the case 11, more specifically, to the front panel 13.

In the packing member 100, the second fixing part 170 may be connected to the first fixing part 160 inserted into the packing member 100. The second fixing part 170 may be formed to protrude from the first fixing part 160 in an outward direction of the packing member 100, for example, in a rearward direction of the packing member 100.

The second fixing part 170 may be formed to protrude from the first fixing part 160 in a hook shape. For example, the second fixing part 170 may be formed to protrude from the first fixing part 160 in a ㄱ shape.

[Coupling Structure between Packing Member and Fixing Member and Cavity]

In the present embodiment, the fixing members 150 are illustrated as being disposed at the corners of the packing member 100. Then, the fixing member 150 may be disposed at each of the corners of the packing member 100 formed in a quadrangular shape.

Guide holes 13*a* corresponding to the fixing members 150 may be provided in the front panel 13. The guide hole 13*a* may be disposed in each of four corners of the front panel 13 formed in the quadrangular shape. Each of the guide holes 13*a* may be formed to pass through the front panel 13 in the front-rear direction, the fixing member 150 may be inserted into the each of the guide holes 13*a*, and thus, the front panel 13 may be insertion-coupled to the fixing member 150.

The guide hole 13*a* may be formed to have a size greater than a size of the fixing member 150. For example, a diameter of the guide hole 13*a* may be set to be greater than a thickness of the first fixing part 160 or a thickness of the second fixing part 170.

Since the size of the fixing member 150 and the diameter of the guide hole 13*a* are set as described above, the fixing member 150 may be very easily inserted into the guide hole 13*a*. Although the fixing member 150 may not be firmly fixed to the front panel 13, the fixing member 150 may be very easily hooked on the front panel 13.

The fixing member 150 may serve to guide a coupling position of the packing member 100 and the case 11, more specifically, the packing member 100 and the front panel 13, and to temporarily fix the packing member 100 at the guided coupling position.

Due to the fixing member 150, an operator may easily hook the packing member 100 on the front panel 13 in a process of assembling the packing member 100, and the packing member 100 may be easily and rapidly fixed temporarily.

In addition, the packing member 100 may further include a coupling protrusion 140. The coupling protrusion 140 may be provided for coupling between the packing member 100 and the front panel 13. The coupling protrusion 140 may be formed to protrude rearward from the first packing part 110.

A coupling hole 13*b* corresponding to the coupling protrusion 140 may be provided in the front panel 13. The coupling hole 13*b* may be formed to pass through the front panel 13 in the front-rear direction. When the coupling protrusion 140 is inserted into the coupling hole 13*b*, the front panel 13 may be insertion-coupled to the coupling protrusion 140. In addition, due to the insertion-coupling between the front panel 13 and the coupling protrusion 140, the packing member 100 may be fixed to the front of the front panel 13.

A plurality of coupling protrusions 140 may be provided in a circumferential direction of the packing member 100, and coupling holes 13*b*, of which the number corresponds to the number of the coupling protrusions 140, may be disposed in the front panel 13 at positions corresponding to the coupling protrusions 140.

Accordingly, the insertion-coupling between the front panel 13 and the coupling protrusions 140 is performed, and thus, the packing member 100 may be stably fixed to the front of the front panel 13.

The insertion-coupling between the front panel 13 and the coupling protrusions 140 may be guided by the fixing member 150. That is, the fixing member 150 may temporarily fix the packing member 100 at a position at which the insertion-coupling between the front panel 13 and the coupling protrusion 140 is performed, and in a state in which the packing member 100 is temporarily fixed at the position guided as described above, the insertion-coupling between the front panel 13 and the coupling protrusion 140 may be easily performed.

To this end, the coupling hole 13*b* may be disposed at a position facing the coupling protrusion 140 in the front-rear direction when the fixing member 150 is hooked on the front panel 13.

[Coupling Structure between Packing Member and Fixing Member]

Figure 9:
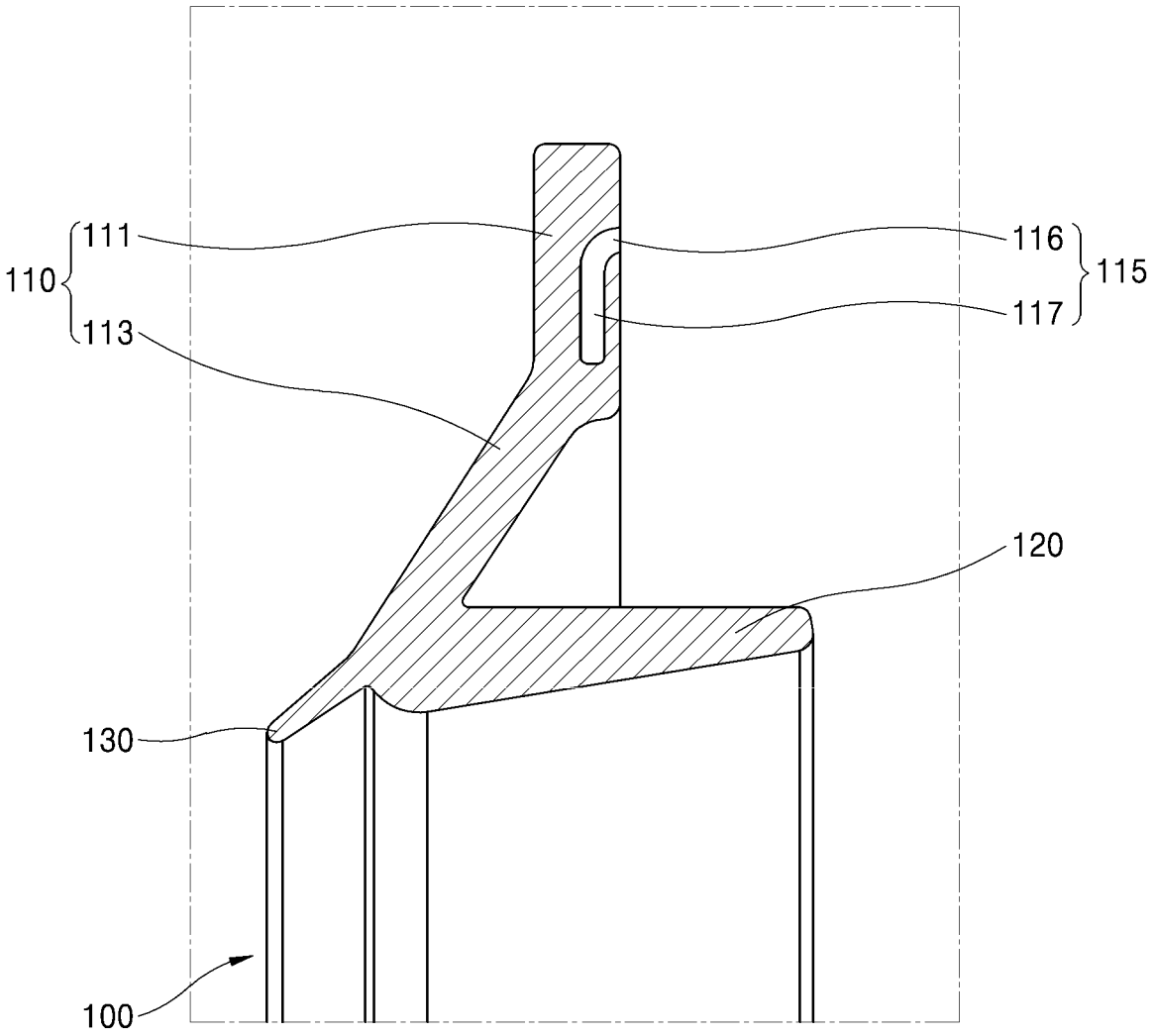
FIG. 9 is a cross-sectional view illustrating an inner structure of the packing member illustrated in FIG. 8.

FIG. 9 is a cross-sectional view illustrating an inner structure of the packing member illustrated in FIG. 8.

Referring to FIGS. 7 to 9, an insertion portion 115 may be formed in the packing member 100. The insertion portion 115 may be formed in the first packing part 110, and at least a part of the first fixing part 160 may be inserted into the insertion portion 115.

The insertion portion 115 may be formed to be recessed into the first packing part 110. The insertion portion 115 may be formed at a position at which both sides in the front-rear direction of the first fixing part 160 inserted into the insertion portion 115 are surrounded by the first packing part 110. In the present embodiment, the insertion portion 115 is illustrated as including a first insertion portion 116 and a second insertion portion 117.

The first insertion portion 116 may be formed to be recessed from one surface of the first packing part 110 toward the second fixing part 170 in a direction toward an inner portion of the first packing part 110. More specifically, the first insertion portion 116 may be formed to be recessed from a rear surface of the first packing body part 111 in the forward direction.

The second insertion portion 117 may be formed to be recessed in the inner portion of the first packing part 110 in a direction different from the direction of the first insertion portion 116 and connected to the first insertion portion 116. The second insertion portion 117 may be disposed to be spaced apart from one side surface of the first packing part 110, more specifically, the rear surface of the first packing body part 111 by a predetermined distance.

For example, the second insertion portion 117 is disposed in the first packing part 110 and may be disposed at a position spaced apart from one side surface of the first packing part 110, more specifically, the rear surface of the first packing body part 111, by 0.5 mm or more.

That is, the second insertion portion 117 may be formed in the first packing part 110 in the form in which a front side and a rear side of the second insertion portion 117 are surrounded by a front surface and the rear surface of the first packing body part 111.

The second insertion portion 117 may be formed to be recessed from a front end portion of the first insertion portion 116 in a direction parallel to the rear surface of the first packing part 110. For example, the insertion portion 115 may be formed in a form in which the first insertion portion 116 is connected to the second insertion portion 117 in an "L" shape.

At least a part of the second fixing part 170 inserted into the insertion portion 115 may be formed in a shape corresponding to a shape of the first insertion portion 116. The second fixing part 170 formed as described above may be connected to the first fixing part 160 in the insertion portion 115. In addition, the first fixing part 160 may be formed to extend from the second fixing part 170 inserted into the first insertion portion 116 in a direction parallel to a direction in which the second insertion portion 117 is recessed.

The fixing member 150 formed as described above may be coupled to the packing member 100 in the form in which the first fixing part 160 is inserted into the second insertion portion 117 and the second fixing part 170 protrudes outward from the packing member 100 through the first insertion portion 116. That is, the fixing member 150 is coupled to the packing member 100 in the form in which the first fixing part 160 is insertion-coupled to the second insertion portion 117, and a part of the fixing member 150, that is, the second fixing part, may protrude rearward from the packing member 100.

In the first packing part 110, a front surface and a rear surface of the first fixing part 160 inserted into the second insertion portion 117 may be pressed against an inner surface of the first packing part 110. As described above, in a state in which the front surface and the rear surface of the first fixing part 160 are pressed against the inner surface of the first packing part 110, the first fixing part 160 may be fixed to the inner portion of the first packing part 110.

The packing member 100 may be molded using a thermoplastic resin in an injection manner. For example, the packing member 100 may be molded using a fluorine rubber resin in an injection manner. In addition, the fixing member 150 may be formed of a metal material.

The packing member 100 and the fixing member 150 may be integrally molded in an insert-injection manner. Then, in a state in which the first fixing part 160 is inserted into the first packing part 110, the packing member 100 and the fixing member 150 are insert-injected, and thus, the packing member 100 and the fixing member 150 may be integrally molded.

When the packing member 100 and the fixing member 150 are integrally molded as described above, in the packing member 100, a portion into which the fixing member 150 is inserted corresponds to the insertion portion 115. The second insertion portion 117 of the fixing member 150 is disposed at a position spaced apart from the rear surface of the first packing body part 111 by 0.5 mm or more, and the rear surface of the first fixing part 160 inserted into the second insertion portion 117 is covered with a part of the packing member 100 by a thickness of 0.5 mm or more.

That is, in the fixing member 150, a periphery of the first fixing part 160 which is a portion inserted into the packing member 100 is surrounded by the packing member 100, and the fixing member 150 and the packing member 100 are coupled in a form in which the packing member 100 surrounds portions of the first fixing part 160 with a thickness of 0.5 mm or more.

According to the present embodiment, the packing member 100 may be formed of a fluorine rubber resin, and the fixing member 150 may be formed of a metal material. The packing member 100 formed of the fluorine rubber resin material has a higher heat resistance than a packing member formed of a silicone rubber material.

Accordingly, as illustrated in the present embodiment, the packing member 100 formed of the fluorine rubber resin material may not be cured even when exposed to high temperatures and may maintain the elastic restoring force. The packing member 100 may not crumble and may effectively maintain a sealed state of the cooking chamber even when exposed to the high temperatures while cooking.

Since a strength of fluorine rubber is lower than a strength of silicone rubber, the fluorine rubber has a property of being easily torn when compared to the silicone rubber. In addition, the fluorine rubber has a lower moldability than the silicone rubber. That is, when the packing member is molded using the fluorine rubber material, there is a possibility in which the packing member may be molded in a state in which the packing member does not properly surround a periphery of the fixing member.

By considering this, in the present embodiment, a position of the insertion portion 115 is set so that a position, at which the fixing member 150 is inserted into the packing member 100, is spaced apart from the rear surface of the packing member 100 by 0.5 mm or more.

Accordingly, the second insertion portion 117 is disposed at a position spaced apart from the rear surface of the first packing body part 111 by 0.5 mm or more. As described above, when the position of the second insertion portion 117 is set, although the fluorine rubber has lower moldability than the silicone rubber, the packing member 100 may surround the periphery of the fixing member 150 with a sufficient thickness in an insert-injection process.

For example, when the second insertion portion 117 is disposed at a position spaced apart from the rear surface of the first packing body part 111 by only about 0.1 mm, there is a high possibility of insert-injection molding being performed in a state in which the packing member 100 does not properly surround the rear surface of the first fixing part 160.

The reason why the moldability of the fluorine rubber is insufficient is that flowability of the fluorine rubber resin melted for injection is insufficient. As described above, it is not easy to form a thin film having a thickness of 0.1 mm or less with the fluorine rubber resin having the insufficient flowability on the rear surface of the first fixing part 160.

That is, when the second insertion portion 117 is disposed at a position spaced apart from the rear surface of the first packing body part 111 by only about 0.1 mm, due to the property of the fluorine rubber having the insufficient moldability, a possibility of insert-injection molding being performed in a state in which the packing member 100 does not properly cover the rear surface of the first fixing part 160 is raised.

In contrast, in the present embodiment, since a position of the insertion portion 115 is set so that a position, at which the fixing member 150 is inserted into the packing member 100, is disposed to be spaced apart from the rear surface of the packing member 100 by 0.5 mm or more, even when the insert-injection molding is performed using the fluorine rubber resin having insufficient flowability, the packing member 100 may surround the periphery of the fixing member 150 with a sufficient thickness.

That is, due to the property of the fluorine rubber resin having the insufficient flowability, even when it is difficult to form a film covering the rear surface of the first fixing part 160 with a thickness of 0.5 mm, inset-injection molding may not be performed at least in a state in which the packing member 100 does not properly cover the rear surface of the first fixing part 160.

In addition, as the position of the insertion portion 115 is set as described above, the film, which covers the rear surface of the first fixing part 160 with the thickness of about 0.5 mm, may be formed. Accordingly, the packing member 100 may be effectively suppressed from being torn at a peripheral portion of the fixing member 150, and thus, the risk of separation of the fixing member 150 may be significantly lowered.

In addition, in a process in which the molded product is separated from a mold after the packing member 100 and the fixing member 150 are integrally molded in the insert-injection manner, a phenomenon, in which the packing member 100 is torn or the fixing member 150 is separated from the packing member 100, may also be effectively suppressed.

In addition, when the fixing member 150 and the packing member 100 are coupled in the form in which the periphery of the fixing member 150 is surrounded by the packing member 100 with the above-described thickness, even when a strength of the fluorine rubber is lower than a strength of the silicone rubber, a possibility of the packing member 100 being torn at the peripheral portion of the fixing member 150 is rather lowered when compared to the packing member formed of the silicone rubber.

Since the packing member 100 surrounds the periphery of the fixing member 150 with the thickness much greater than a thickness of a conventional packing member formed of the silicone rubber, an influence of strength degradation due to a material property can be cancelled by an effect of strength improvement due to an increase in thickness, and furthermore, the fixing member 150 and the packing member 100 can be coupled more firmly.

While the invention has been described with reference to the embodiments illustrated in the accompanying drawings, the embodiments should be considered in a descriptive sense only, and it should be understood that various alterations and equivalent other embodiments may be made by those skilled in the art. Therefore, the scope of the invention is defined by the appended claims.

What is claimed is:

1. A cooking appliance comprising:

a case that defines a cooking chamber and an opening at a front of the cooking chamber;

a door disposed at a front of the case and configured to open and close the opening;

a front panel disposed between the case and the door;

a packing member disposed between the case and the door; and a fixing member that couples the packing member to the case or the door, wherein the fixing member and the packing member are coupled to the front panel, and wherein the packing member comprises:

a first packing part that surrounds the opening of the case and receives at least a part of the fixing member, a second packing part that protrudes from the first packing part toward one of the door or the cooking chamber, and a coupling protrusion coupled to the front panel.

2. The cooking appliance of claim 1, wherein the fixing member comprises:

a first fixing part inserted into the first packing part; and a second fixing part connected to the first fixing part and coupled to the case or the door, and wherein the first packing part defines an insertion portion that is recessed into an inside of the first packing part and receives at least a part of the first fixing part.

3. The cooking appliance of claim 2, wherein the insertion portion receives the first fixing part such that a front side and a rear side of the first fixing part are covered by the first packing part.

4. The cooking appliance of claim 2, wherein the insertion portion comprises:

a first insertion portion recessed from a first surface of the first packing part, the first insertion portion extending in a first direction toward the inside of the first packing part; and a second insertion portion connected to the first insertion portion and further recessed into the inside of the first packing part in a second direction different from the first direction, the second insertion portion being spaced apart from the first surface of the first packing part by a predetermined distance.

5. The cooking appliance of claim 4, wherein the second insertion portion receives the first fixing part such that a front side and a rear side of the first fixing part are covered by the first packing part, and wherein the first insertion portion passes through the first surface of the first packing part and is open toward the second fixing part.

6. The cooking appliance of claim 4, wherein the first surface is a rear surface of the first packing part, the first insertion portion being recessed from the rear surface of the first packing part in a forward direction, and wherein the second insertion portion is recessed from a front end portion of the first insertion portion in a direction parallel to the rear surface of the first packing part.

7. The cooking appliance of claim 4, wherein the first insertion portion and the second insertion portion are connected to each other and define an "L" shape.

8. The cooking appliance of claim 4, wherein the second insertion portion is spaced apart from the first surface of the first packing part by 0.5 mm or more.

9. The cooking appliance of claim 4, wherein at least a part of the second fixing part is inserted into of the first insertion portion and has a shape corresponding to a shape of the first insertion portion, the second fixing part being connected to the first fixing part that is inserted in the second insertion portion, and wherein the first fixing part extends from the second fixing part parallel to a direction in which the second insertion portion is recessed from the first insertion portion.

10. The cooking appliance of claim 9, wherein the first packing part has an inner surface that is in contact with and presses a front surface and a rear surface of the first fixing part that is inserted into the second insertion portion, and wherein the first fixing part is fixed to the inner surface of the first packing part.

11. The cooking appliance of claim 9, wherein the packing member and the fixing member are integrally molded by injection molding in a state in which the first fixing part is inserted into the first packing part.

12. The cooking appliance of claim 1, wherein the fixing member comprises a hook that has a curved shape and couples the packing member to the front panel.

13. The cooking appliance of claim 1, wherein the front panel defines a guide hole and a coupling hole that pass through the front panel in a front-rear direction, wherein the fixing member is inserted into the guide hole and curved to couple the packing member to the front panel, wherein the coupling protrusion is inserted into the coupling hole to couple the packing member to the front panel, and wherein the coupling hole faces the coupling protrusion in the front-rear direction.

14. The cooking appliance of claim 13, wherein a size of the guide hole is greater than a thickness of the fixing member.

15. The cooking appliance of claim 14, wherein the first packing part covers a space outside the fixing member in the guide hole.

16. The cooking appliance of claim 13, wherein the coupling protrusion extends along a portion of a perimeter of the first packing part, and the coupling hole extends along a side of the front panel.

17. The cooking appliance of claim 1, wherein the second packing part protrudes from the first packing part toward the cooking chamber, and wherein the packing member further comprises a third packing part that protrudes from the first packing part toward the door.

18. The cooking appliance of claim 1, wherein a heat resistance of the packing member is greater than a heat resistance of silicone rubber.

19. The cooking appliance of claim 1, wherein the packing member is made of a fluorine rubber material.

* * * * *